US007009155B1

(12) United States Patent
Fan

(10) Patent No.: US 7,009,155 B1
(45) Date of Patent: Mar. 7, 2006

(54) FAR-INFRARED HEATING DEVICE

(76) Inventor: Chi-Cheng Fan, 3F, No. 14, Lane 133, Chunghsing St., Yungho City, Taipei Hsien (TW)

( * ) Notice: Subject to any disclaimer, the term of this patent is extended or adjusted under 35 U.S.C. 154(b) by 0 days.

(21) Appl. No.: 10/943,555

(22) Filed: Sep. 17, 2004

(51) Int. Cl.
*H05B 3/02* (2006.01)

(52) U.S. Cl. ..... 219/538; 219/212; 219/217; 219/529; 219/553

(58) Field of Classification Search ..... 219/200–201, 219/212, 217, 520, 528, 529, 538, 541, 542, 219/545, 546, 547–549, 552–553; 5/421
See application file for complete search history.

(56) References Cited

U.S. PATENT DOCUMENTS 4,825,868 A * 5/1989 Susa et al. ..... 219/553
5,787,525 A * 8/1998 Sugihara et al. ..... 219/217

* cited by examiner

*Primary Examiner*—Tu Hoang
(74) *Attorney, Agent, or Firm*—Jackson Walker, LLP

(57) ABSTRACT

The far-infrared heating device has a far-infrared element and two pieces of cloth. The far-infrared element has a wire grid and two membranes. The wire grid is connected to a power supply. When electricity is fed to the wire grid, the wire grid generates heat that passes through the membranes, and the heat becomes far-infrared rays.

2 Claims, 3 Drawing Sheets

FAR-INFRARED HEATING DEVICE

BACKGROUND OF THE INVENTION

1. Field of the Invention

The present invention relates to a far-infrared heating device, especially to a far-infrared heating device for clothes, mattresses, blankets, etc.

2. Description of the Prior Arts

Over the years, people have learned how to make clothes with natural materials and artificial materials and use clothes to protect themselves from hostile environment and to dress up. Today, protective and fancy clothing are basic requirements. With the advance of technology in many fields, people have begun to ask for clothes that have new and modern features.

Therefore, the present invention provides a far-infrared heating device to provide a new feature for clothes.

SUMMARY OF THE INVENTION

The main objective of the present invention is to provide a far-infrared heating device for clothes, mattresses or blankets to enhance the blood circulation of the human body.

The far-infrared heating device in accordance with the present invention comprises a far-infrared element and two layers of cloth. The far-infrared element has a wire grid and two membranes. The wire grid is connected to a power supply. When electricity is fed to the wire grid, the wire grid generates heat that radiates through the membranes, and the heat becomes far-infrared rays.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
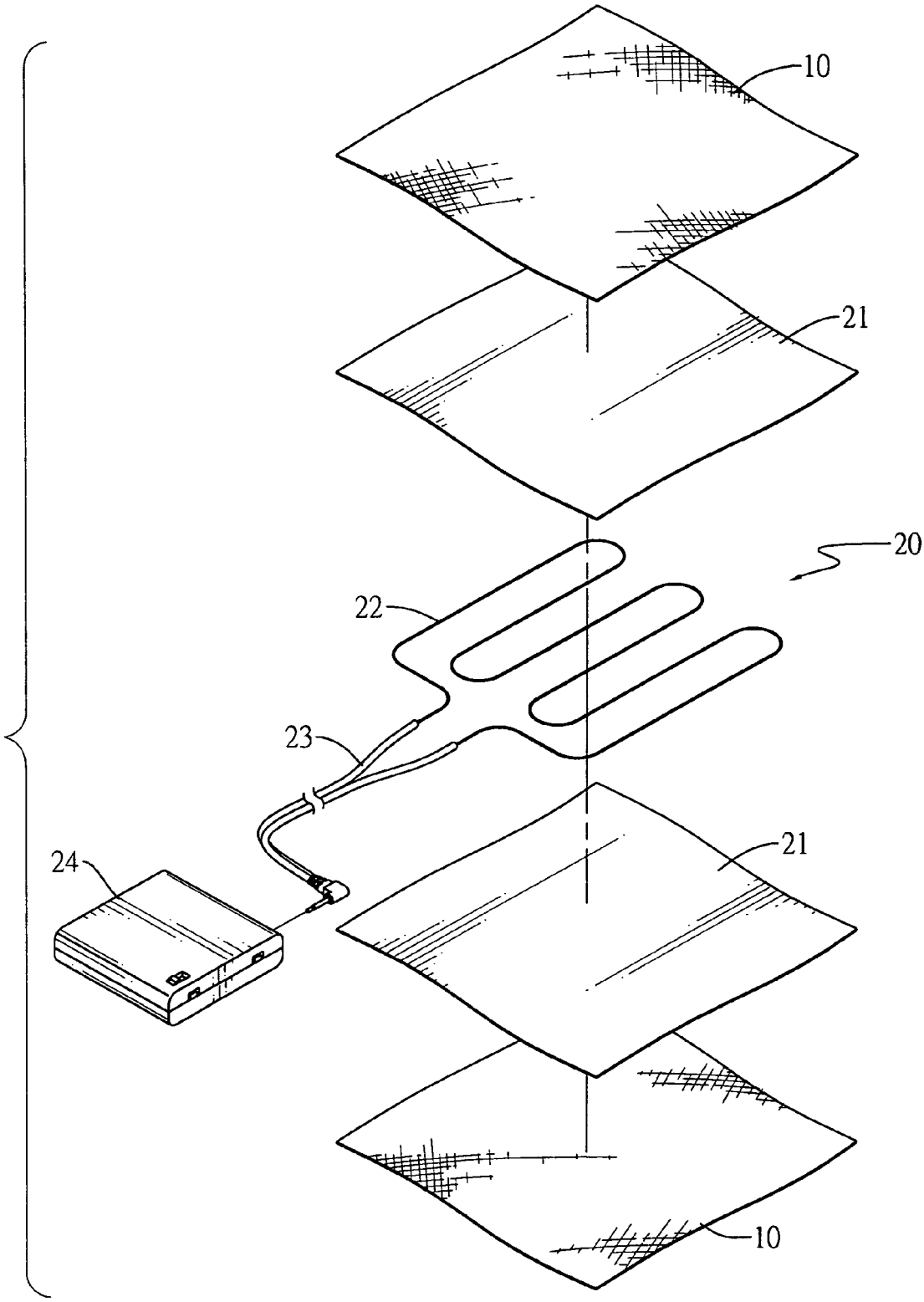
FIG. 1 is an exploded perspective view of a far-infrared heating device in accordance with the present invention.
Figure 2:
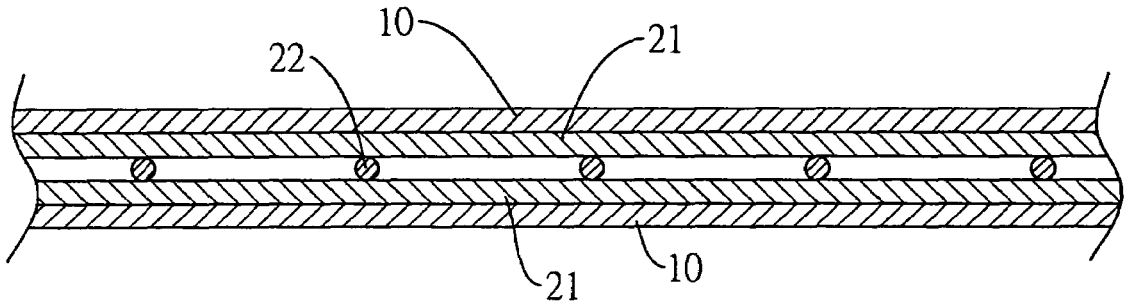
FIG. 2 is a cross sectional side view of the far-infrared heating device in FIG. 1.

With reference to FIGS. 1 and 2, a far-infrared heating device in accordance with the present invention comprises a far-infrared element (20) and two layers of cloth (10).

The far-infrared element (20) comprises a wire grid (22), two membranes (21) and a power cord (23). The wire grid (22) has a top and a bottom. The two membranes (21) are made from far-infrared micrometer pellets and are attached respectively to the top and the bottom of the wire grid (22). The power cord (23) has a proximal end and a distal end. The proximal end of the power cord (23) is connected to the wire grid (22). The distal end of the power cord (23) is connected to the power supply to provide electricity. The power supply may be an electrical outlet or a battery box (24). The battery box (24) has batteries inside to provide electrical power.

The two pieces of cloth (10) are attached respectively to the two membranes (11).

Figure 3:
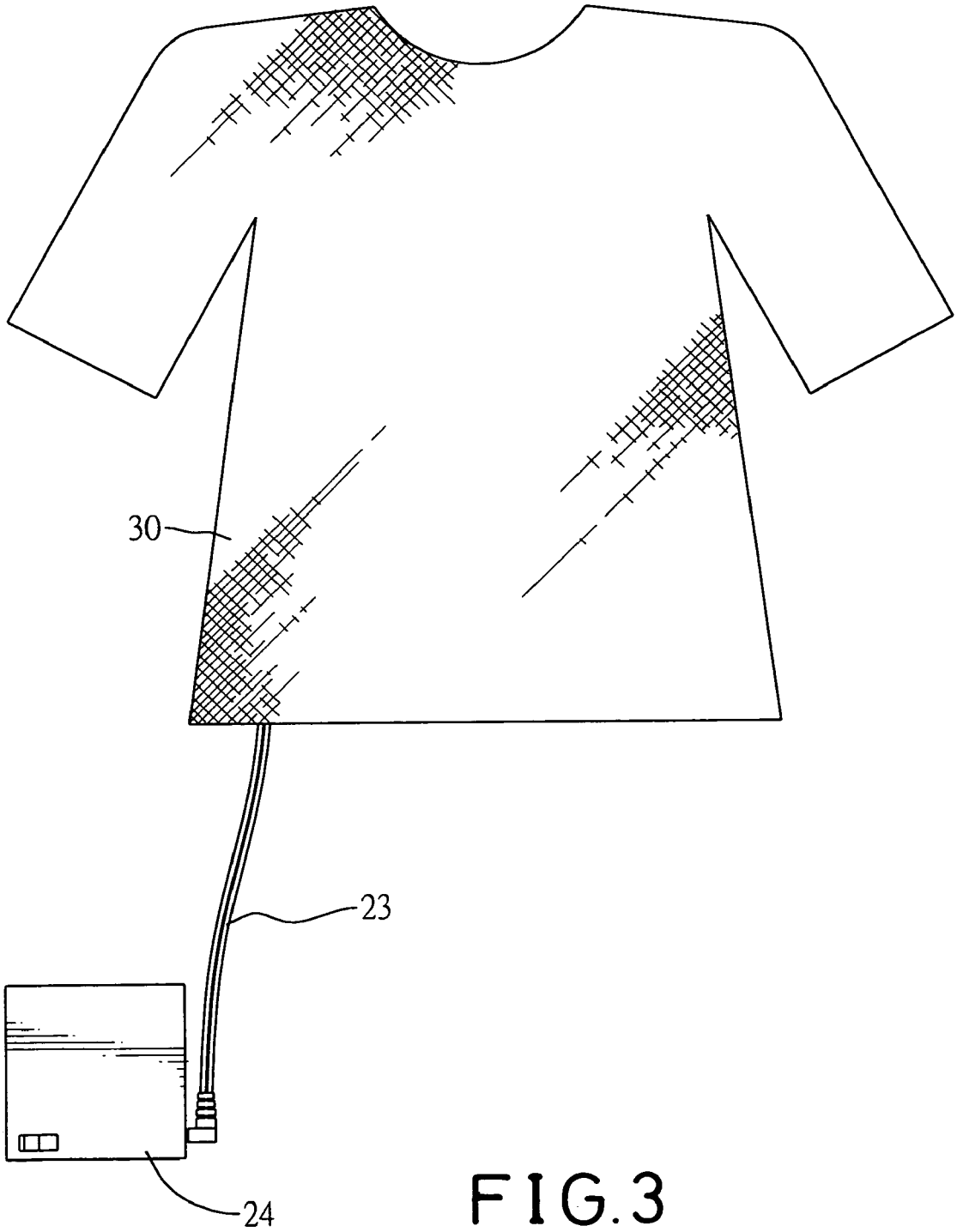
FIG. 3 is a front view of a piece of clothing with the far-infrared heating device in FIG. 1 inside.

With further reference to FIG. 3, the far-infrared heating device as described can be mounted in pieces of clothing (30), mattresses, blankets, etc. The power supply feeds electricity through the power cord (23) to the wire grid (22). Then the wire grid (22) generates heat. The heat passes through the membranes (21). Because the membranes (21) are made from far-infrared micrometer pellets, heat radiated from the membranes (21) will be far-infrared rays. The far-infrared rays generated by the far-infrared heating device can provide heat, advance blood circulation and further treat the human body.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A far-infrared heating device comprising a far-infrared element having a wire grid having a top and a bottom;

two membranes made from far-infrared micrometer pellets and attached respectively to the top and the bottom of the wire grid; and a power cord having a proximal end connected to the wire grid; and a distal end connected to a power supply; and two pieces of cloth attached respectively to the two membranes.

2. The far-infrared heating device as claimed in claim 1, wherein the power supply is a battery box.

* * * * *